US011807971B2

(12) United States Patent
Beauduin et al.

(10) Patent No.: US 11,807,971 B2
(45) Date of Patent: Nov. 7, 2023

(54) TUFTING TOOL WITH INSERT

(71) Applicant: VANDEWIELE SWEDEN AB, Ulricehamn (SE)

(72) Inventors: Charles Beauduin, Halle (BE); Tobias Sternfeldt, Ulricehamn (SE); Michael Holmudden, Ulricehamn (SE)

(73) Assignee: VANDEWIELE SWEDEN AB, Ulricehamn (SE)

( * ) Notice: Subject to any disclaimer, the term of this patent is extended or adjusted under 35 U.S.C. 154(b) by 0 days.

(21) Appl. No.: 17/774,964

(22) PCT Filed: Oct. 21, 2020

(86) PCT No.: PCT/SE2020/051014
§ 371 (c)(1),
(2) Date: May 6, 2022

(87) PCT Pub. No.: WO2021/091451
PCT Pub. Date: May 14, 2021

(65) Prior Publication Data

US 2022/0380955 A1 Dec. 1, 2022

(30) Foreign Application Priority Data

Nov. 7, 2019 (SE) ..... 1951277-1

(51) Int. Cl.
*D05C 15/22* (2006.01)

(52) U.S. Cl.
CPC ..... *D05C 15/22* (2013.01)

(58) Field of Classification Search
CPC ..... D05C 15/16–36
See application file for complete search history.

(56) References Cited

U.S. PATENT DOCUMENTS 3,152,563 A * 10/1964 Broadrick ..... D05C 15/24 112/80.55
3,732,771 A * 5/1973 Kinoshita ..... C22C 38/18 83/663
4,155,318 A * 5/1979 Yamamoto ..... D05C 15/22 112/80.59
4,303,024 A 12/1981 Bardsley
5,860,373 A 1/1999 Beyer et al.
(Continued)

FOREIGN PATENT DOCUMENTS

EP 1 953 290 1/2013

OTHER PUBLICATIONS

International Search Report for PCT/SE2020/051014 dated Dec. 14, 2020 (3 pages).

(Continued)

*Primary Examiner* — Ismael Izaguirre
(74) *Attorney, Agent, or Firm* — NIXON & VANDERHYE P.C.

(57) ABSTRACT

A tufting tool (20) is provided. The tufting tool can be adapted to be used in a tufting machine. The tufting tool is formed by a first material (22). The tufting tool comprises an insert of a second material (24), where the second material is harder than the first material. The insert is formed by a cavity in the first material filled with the second, melted, material filling said cavity. Hereby a tufting tool with an insert can be made in a robust and efficient manner.

19 Claims, 4 Drawing Sheets

(56) References Cited

U.S. PATENT DOCUMENTS

| | | | | |
|---|---|---|---|---|
| 7,562,632 | B2 * | 7/2009 | Hillenbrand | D05C 15/22 112/80.55 |
| 8,302,546 | B2 * | 11/2012 | Bitzer | D05C 15/22 112/80.5 |
| 2010/0101470 | A1 | 4/2010 | Hillenbrand et al. | |
| 2012/0024208 | A1 | 2/2012 | Buchle et al. | |

OTHER PUBLICATIONS

Written Opinion of the International Searching Authority for PCT/SE2020/051014 dated Dec. 14, 2020 (5 pages).

* cited by examiner

TUFTING TOOL WITH INSERT

This application is the U.S. national phase of International Application No. PCT/SE2020/051014 filed Oct. 21, 2020 which designated the U.S. and claims priority to SE 1951277-1 filed Nov. 7, 2019, the entire contents of each of which are hereby incorporated by reference.

TECHNICAL FIELD

The present disclosure relates to tufting and in particular to a tufting tool. The present disclosure also relates to a method of manufacturing a tufting tool and to a tufting tool module.

BACKGROUND

In tufting, a textile is produced by a textile process in which a thread is inserted on a primary base. Specialized machinery can be used to produce a tufted textile. Such machinery typically can make use of tufting tools to insert the thread to the primary base and to apply the thread in a described manner. The tufting tool is typically made of a steel material. In some applications the tufting tools are provided in a tufting tool module to facilitate reconfiguration of the machinery for different applications. In a tufting tool module, a plurality of tools is embedded within a common cast body member in a side-by-side configuration. To ensure a good function of the loop forming and a good quality of the tufted fabric, it is essential that the different tufting tools are aligned with each other with very high precision. Typically, a tufting machine can hold 2000 needles, hooks and knifes, and they need to match each other with a precision of tenths of a millimeter, or sometimes even hundreds of a millimeter.

Known tufting tool modules are described in for example U.S. Pat. Nos. 4,303,024 and 5,860,373.

Some tufting tools are provided with so-called inserts. For example, when the yarn loop in a tufting machine is cut with the knife there is a wear on the cutting edge of the tufting tool being made of a steel material. With some yarns this wear is excessive and in these cases an insert of a hard metal/material is provided on the tufting tool where the wear takes place. The hard metal/material can for example be a Tungsten material. This insert is typically secured with a brazing process using a heater and brazing paste. An insert can therefore typically be a component made of a material harder than the rest of the tufting tool to resist wear on the tufting tool.

Known inserts are described US 2012/0024208, EP1 953290B1 and U.S. Pat. No. 4,155,318.

There is a constant desire to improve textile machines including tufting machines and parts used within such machinery. Hence, there is a need for an improved tufting tool that can be used in a tufting machine.

SUMMARY

It is an object of the present invention to improve tufting machines and in particular to provide an improved tufting tool, a tufting tool module and a method of manufacturing a tufting tool.

This object and/or others are obtained by the tufting tool, the tufting tool module and the method of producing a tufting tool as set out in the appended claims.

As has been realized, there are some problems and limitations when joining steel and hard metal with a brazing process or other known processes. For example, in a brazing process, the steel, the brazing paste and the hard metal is heated to several hundred degrees Celsius. All the materials then elongate due to thermal expansion but the steel elongates longer than the hard metal due to the different physical properties of the different materials. Therefore, there is a risk that a high tension is built into the joint between the steel material and the hard metal/material when the materials cool down and shrinks. This in turn can lead to cracking of the hard metal/material component forming the insert.

Further, the paste used to join the steel and hard metal during a brazing process is expensive due to its high concentration of rare earth metals, and it releases dangerous fumes when heated, making it hazardous for operators and the environment. In addition, the paste material is much softer than the steel and the hard metal. This will lead to that, even after the brazing process, the joint of the brazing material is more prone to wear and tear. The joint is typically 0.1-0.2 mm thick and is exposed to wear by the yarn so it exposes the sharp edge of the hard metal insert. This sharp edge can damage the filaments of the tuft yarn.

Yet another problem with a brazing process to provide an insert in a tufting tool is that, due to the complexity of controlling the brazing process, there is a risk for unnecessary high discarding of defect components. For instance, if the amount of brazing paste applied is not correct or the gap between the hard metal and steel for the brazing paste to fill up with capillary action is wrong, it can lead to pores, cracks and cavities in the joint.

To reduce, or even eliminate, the problems of known processes for producing a tufting tool with an insert, the insert is formed by a filled cavity in the steel material.

In accordance with the invention a tufting tool is provided. The tufting tool can be adapted to be used in a tufting machine. The tufting tool is formed by a first material. The tufting tool comprises an insert of a second material, where the second material is harder than the first material. The insert is formed by a cavity in the first material filled with the second, melted, material filling said cavity. Hereby a tufting tool with an insert can be made in a robust and efficient manner. Also, other benefits can be achieved as will be apparent from the description herein.

The cavity in the first material can advantageously be 0.2-0.8 mm deep, and in particular 0.3-0.6 mm deep.

The first material, from which the tufting tool is made can in accordance with some embodiments be a hardened steel material. In accordance with other embodiments the first material is an un-hardened steel material.

The second material can for example be one or more of: Hard metal alloy, Tungsten/Wolfram carbide, titanium or chromium.

In accordance with some embodiments, the second material is a non-metal material. For example, the second material can be a bonding material combined with one or more of: a ceramics material, CBN cubic boron nitride or HPHT diamond or CVD diamond.

The tufting tool can in accordance with some embodiments be a hook. The tufting tool can in accordance with some embodiments be a Level Cut Looper, LCL, hook.

The invention also extends to a tufting tool module for a tufting machine, where the tufting tool module comprising a plurality of tufting tools according to the above, and a base block where the tufting tools are fixed in the base block for example by casting.

The invention also extends to a method of producing a tufting tool with an insert for a tufting machine. The method comprises to form a tufting tool in a first material and to form a cavity in the tufting tool at a location where the insert is to be provided in the tufting tool. The cavity is filled with a second material, the second material being a material being harder than the first material. The second material can be a granular material or paste. The second material is melted to form the insert. The melting can be performed by the use of concentrated energy such as a laser beam or an electron beam.

In accordance with some embodiments the outside of the insert is then machined.

BRIEF DESCRIPTION OF THE DRAWINGS

The present invention will now be described in more detail by way of non-limiting examples and with reference to the accompanying drawings, in which.

DETAILED DESCRIPTION

Figure 1:
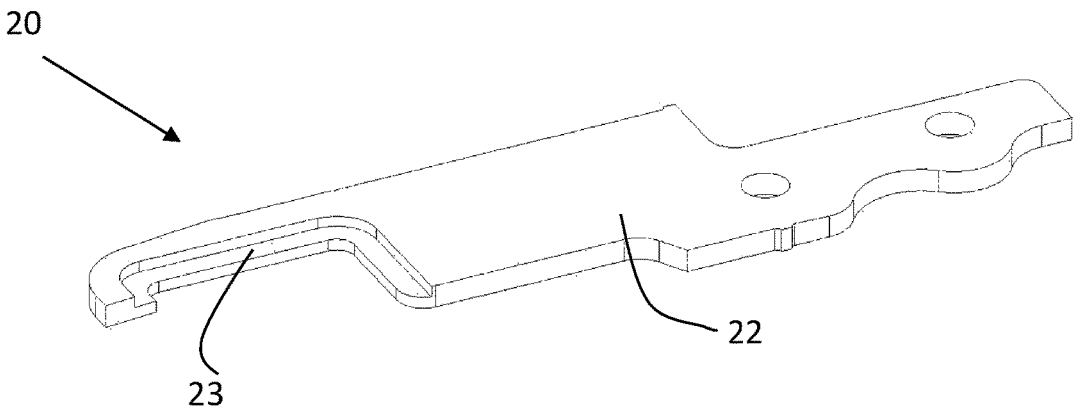
FIG. 1 is a view in perspective of a tufting tool with a cavity.

In the following an exemplary tufting tool will be described. In the Figures, the same reference numerals designate identical or corresponding elements throughout the several figures. It will be appreciated that these figures are for illustration only and are not in any way restricting the scope of the invention. Also, it is possible to combine features from different described embodiments to meet specific implementation needs. Further, in the description herein a cavity is filled with a melted, hard, material that is cooled. The result is a tufting tool with a filled cavity of a hard material. The filled cavity with hard material is referred to as an insert herein.

In FIG. 1, an exemplary tufting tool 20 is shown. The tufting tool, 20 is in FIG. 1 a hook, but in other embodiments other tufting tools can be envisaged such as an LCL hook or some other tufting tool where it can be advantageous to provide an insert. The tufting tool 20 comprises a body 22. The body 22 can be made of a steel material such as hardened or an unhardened steel material. The body 2 can typically be 1-2.5 mm thick. The body 22 has a cavity 23 formed therein.

The cavity can in accordance with some exemplary embodiments have a depth of about 0.2-0.8 mm. In particular the cavity 23 can be 0.3-0.6 mm deep. The cavity 23 can be formed when manufacturing the body 22. For example, the body 22 can be formed from a steel material using electrical discharge machining. The cavity 23 can be formed using milling, grinding, electrical discharge machining or using some other type of machining.

The cavity 23 is machined at a location where an insert is to be provided in the tufting tool.

The cavity 23 is then filled with a material, in particular a granular material. The material filling the cavity 23 is harder than the material used to form the body 22. The material in the cavity is then melted. The material in the cavity 23 is harder than the material of the body 22. The material in the cavity 23 can for example be a hard metal alloy, Tungsten/Wolfram carbide, titanium or chromium or some other hard metal. In accordance with some embodiments the material in the cavity is a non-metal material. For example, the material in the cavity can be a bonding material combined with one or more of: a ceramics material, CBN cubic boron nitride or HPHT diamond or CVD diamond.

Figure 2:
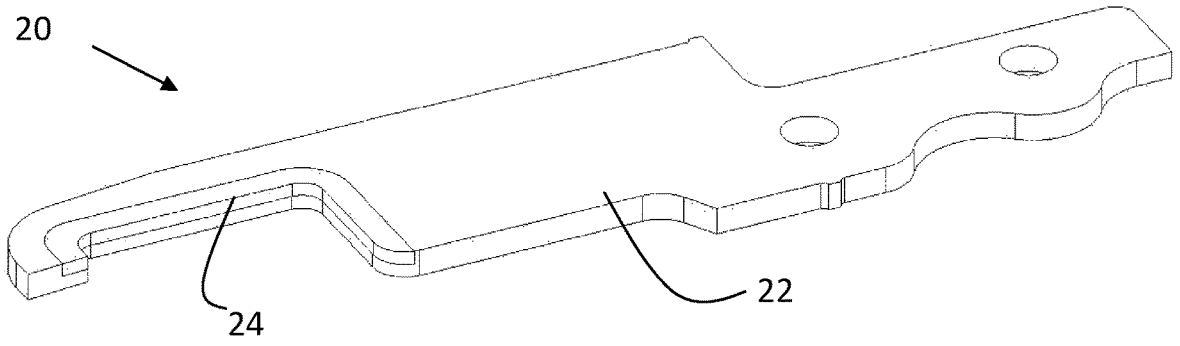
FIG. 2 is a view in perspective of a tufting tool with a filled cavity.

In FIG. 2 a perspective view of the hook 20 of FIG. 1 is shown with melted material 24 in the cavity of the body 22.

Figure 3A:
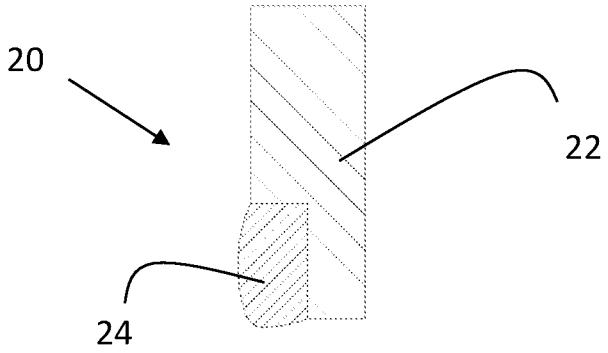
FIGS. 3*a* and 3*b* are a cross sectional views of a tufting tool with a filled cavity.
Figure 3B:
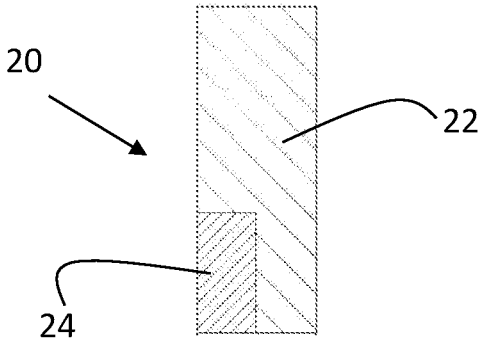

In FIG. 3*a*, a front cross-sectional view of the hook 20 of FIG. 2 is shown in a production state when a cavity is over-filled with material 24 that has been melted. The hook 20 has melted material 24 in the cavity of the body 22. In FIG. 3*b* a front cross-sectional view of the hook 20 of FIG. 2 is shown in a production state when the over-filled cavity with melted material 24 has been machined as will described.

Figure 4:
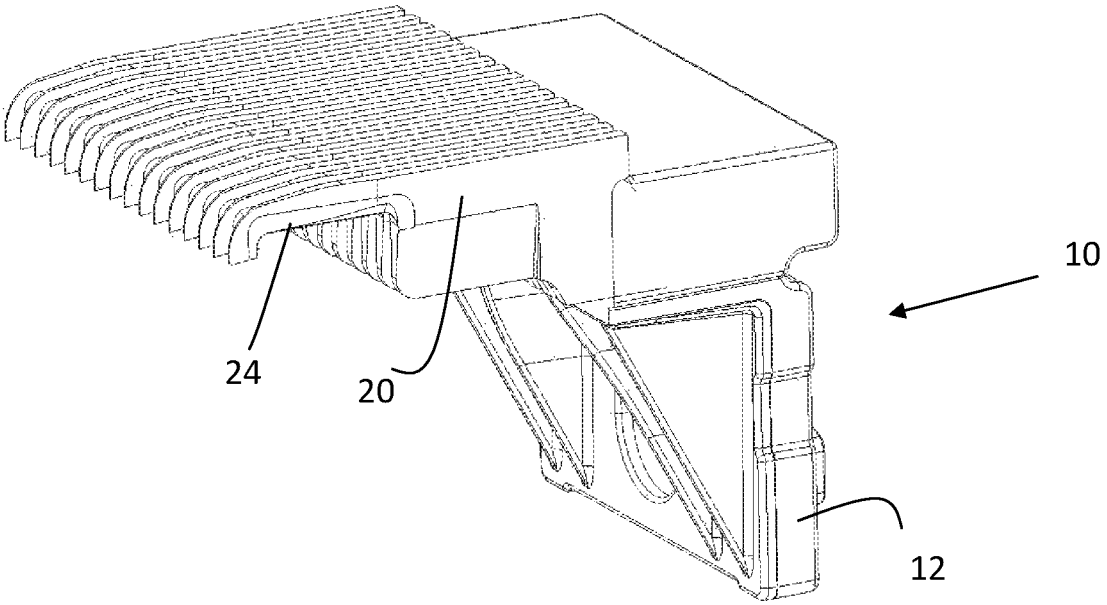
FIG. 4 is a view perspective of a tufting tool module.

In FIG. 4 a view in perspective of a tufting tool module 10 is shown. The tufting tool module 10 comprises a plurality of tufting tools 20 as described above. The tufting tools 20 are casted in a base block 12. The base block 12 can typically be a Zinc block.

Figure 5:
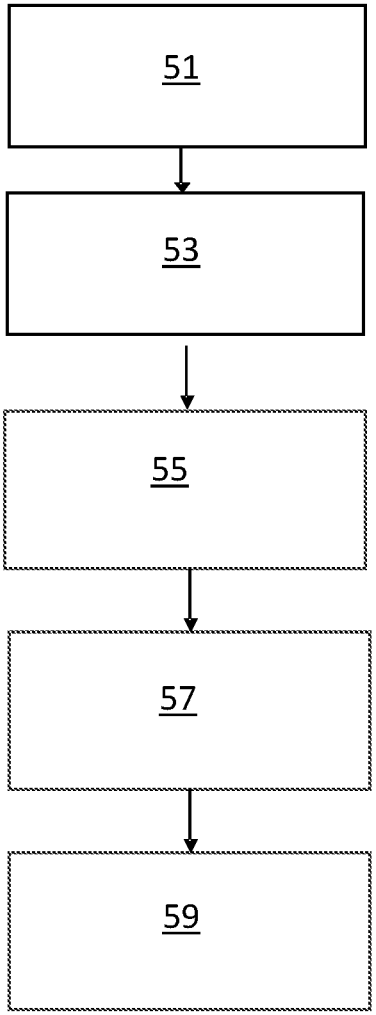
FIG. 5 is a flow chart illustrating some steps performed when producing a tufting tool with a filled cavity.

In FIG. 5 a flow chart illustrating some steps performed when manufacturing a tufting tool in accordance with the above is shown. First, in a step 51, a body of the tufting tool is formed. The body of the tufting tool can for example be formed by electrical discharge machining of some suitable material such as a steel material. The steel material can for example be a hardened or an un-hardened steel material. Then, in a step 53, a cavity is machined in the body. The machining of the cavity can in accordance with some embodiments be made in a following step by milling or grinding. The machining of the cavity can in accordance with some other embodiments take place at the same time as when the body is machined. Next, in a step 55, a hard material, being harder than the body is filled in the cavity. The material filling the cavity can typically be a granular material or it can be a paste such as a bonding material mixed with a ceramic material or some other suitable material. The granular material can be filled via a nozzle running along a computer-controlled path. In accordance with some embodiments the cavity is over-filled with material. When the cavity has been filled, the material in the cavity is melted in a step 57. The melting can in accordance with some embodiments be performed with the use of concentrated energy, for instance a laser beam, electron beam or similar. The granulate is then melted and fills up the cavity with a solid material much harder than the surrounding steel. Hereby an area of the tufting tool with different characteristics is formed. The resulting tufting tool will have a combination of different properties. Wear resistance on the cutting edge is achieved by the melted granulate in the cavity and flexibility of the entire tufting tool is made possible with the surrounding steel.

Further, the concentrated energy needed to melt the granulate can be concentrated to target only the area that needs to be heated. As a result, the melting of the hard material typically will not cause the disadvantages of existing methods for providing an insert such as cracks, or deformation. There is also no extra material such as brazing paste. This reduces the disadvantages caused by the brazing material such as pores, cracks and cavities in the joint.

When the material in the cavity has cooled an insert is formed in the tufting tool. The side of the tufting tool provided with the insert can then be machined in a step 59. For example, a plane grinding and/or a profile grinding can be performed to provide an intended shape of the tufting tool. For instance, the rim that is in contact with a cutting knife can be given a sharp edge. Other further machining can also take place depending on the intended use of the tufting tool.

In the above description a hook has been given as an example. However, the insert can be provided in any tufting tool where an insert is desired such as an LCL hook.

The invention claimed is:

1. A tufting tool for a tufting machine, the tufting tool being formed by a first material, the tufting tool comprising:

an insert of a second material the second material being a granular material or a paste being harder than the first material, and a cavity in the first material, wherein the cavity is filled with the second material which, when melted, fills said cavity to form the insert.

2. The tufting tool according to claim 1, wherein the cavity is 0.2-0.8 mm deep.

3. The tufting tool according to claim 1, wherein the cavity is 0.3-0.6 mm deep.

4. The tufting tool according to claim 1, wherein the first material is a hardened steel material.

5. The tufting tool according to claim 1, wherein the first material is an un-hardened steel material.

6. The tufting tool according to claim 1, wherein the second material is one or more of: Hard metal alloy, Tungsten/Wolfram carbide, titanium or chromium.

7. The tufting tool according to claim 1, wherein the second material is a non-metal material.

8. The tufting tool according to claim 7, wherein the second material is a bonding material combined with one or more of: a ceramics material, CBN cubic boron nitride or HPHT diamond or CVD diamond.

9. The tufting tool according to claim 1, wherein said tufting tool is a hook.

10. The tufting tool according to claim 1, wherein said tufting tool is a Level Cut Looper, LCL, hook.

11. A tufting tool module for a tufting machine, the tufting tool module comprising a plurality of tufting tools according to claim 1, and a base block with the plurality of tufting tool being fixed in the base block.

12. A method of producing a tufting tool with an insert for a tufting machine comprising:

forming a tufting tool in a first material, forming a cavity at a location in the tufting tool where the insert is to be provided in the tufting tool, filling the cavity with a second material, the second material being a granular material or a paste being harder than the first material, and melting the second material to form the insert.

13. The method according to claim 12, wherein the melting is performed by a laser beam or an electron beam.

14. The method according to claim 12, further comprising to machine the tufting tool with the insert formed by the melted second material on the outer surface of the insert.

15. The method according to claim 12, wherein the paste is a bonding material mixed with a ceramic material.

16. The method according to claim 12, wherein the granular material is filled using a nozzle running along a computer-controlled path.

17. The method according to claim 12, wherein the cavity is over-filled with the second material.

18. The tufting tool according to claim 1, wherein the paste is a bonding material mixed with a ceramic material.

19. The tufting tool according to claim 1, wherein the cavity is over-filled with the second material.

* * * * *